United States Patent [19]

Callaghan et al.

[11] Patent Number: 5,069,822

[45] Date of Patent: Dec. 3, 1991

[54] PROTECTIVE COATING FOR REINFORCED CONCRETE

[76] Inventors: Thomas M. Callaghan, 54 Franklin Avenue, Willowdale, Ontario, Canada, M2N 1B6; Vallabhdas M. Pasta, 202 Mohawk Road, Oakville, Ontario, Canada, L6L 2Z2; Vasant D. Kale, 60 Alexander Street, Tottenham, Ontario, Canada, L0G 1W0; Charles A. Bruce, 25 Danville Drive, Willowdale, Ontario, Canada, M2P 1J1

[21] Appl. No.: 335,430

[22] Filed: Apr. 10, 1989

Related U.S. Application Data

[63] Continuation-in-part of Ser. No. 61,473, Jun. 15, 1987, abandoned.

[51] Int. Cl.[5] ..... H01B 1/00

[52] U.S. Cl. ..... 252/511; 252/512; 252/513; 252/518; 252/519; 52/173 R

[58] Field of Search ..... 252/511, 512, 513, 519; 52/173 R, 181, 515, 517, 516

[56] References Cited

U.S. PATENT DOCUMENTS

| | | | |
|---|---|---|---|
| 4,174,992 | 11/1979 | Fujii et al. | 52/515 |
| 4,742,654 | 5/1988 | Cope | 52/173 R |
| 4,790,110 | 12/1988 | Baud | 52/173 R |
| 4,934,116 | 6/1990 | Frederiksen | 52/173 R |

*Primary Examiner*—Josephine Barr

*Attorney, Agent, or Firm*—Gerald D. Sharkin; Robert S. Honor; Walter F. Jewell

[57] ABSTRACT

A protective coating for application to steel reinforced concrete structures, comprising a liquid composition of elastomeric polymeric material having electrically conductive particulate matter evenly dispersed therein. A cathodic protection system embodying the coating comprises a moisture impervious membrane of elastomeric polymeric material having electrically conductive particulate material evenly dispersed therein, an electrically conductive grid embedded in the membrane or contiguous thereto, and direct current means connecting the grid electrically with the reinforcing bars.

12 Claims, 1 Drawing Sheet

PROTECTIVE COATING FOR REINFORCED CONCRETE

RELATED APPLICATION

This application is a continuation in part of U.S. application Ser. No. 061,473 filed June 15, 1987 now abandoned.

FIELD OF THE INVENTION

This invention relates to a protective coating for steel reinforced concrete.

BACKGROUND OF THE INVENTION

All suspended concrete decks in parking facilities contain reinforcing steel. When steel encounters both oxygen and water, rusting can occur. The process may be referred to as galvanic action, electrochemical corrosion, or ionic activity. If sodium chloride (de-icing salt) is used on roadways, it is carried into the garage on the underside of vehicles, drops to the deck surface, and eventually permeates through the concrete to the reinforcing steel (rebars), acting as an electrolyte in the presence of moisture and oxygen. This process greatly accelerates the rusting, which in turn reduces the steel to scale. This transformation of the steel increases its volume and produces extreme stress within the concrete slab, initially creating cracks and eventually spalled areas or potholes. The pressure created by corroding rebars can reach several thousand pounds per square inch.

Since no present system can eliminate oxygen from the concrete slab, it is customary to employ a waterproofing system using an impervious membrane and/or coating with a sealer, which stops the penetration of both moisture and chlorides into the slab. Another method of inhibiting corrosion is to apply a constant negative electric voltage to the reinforcing steel to reverse its anodic property.

An example of such a coating and voltage application presently in use is disclosed in U.S. Pat. No. 4,506,485 issued Mar. 26, 1985 to J. Apostolos which shows a coating of molten metal and a direct current circuit joining the coating and the embedded rebar. The Apostolos system suffers from the disadvantage that the coating provides a sacrificial anode and ablates over a period of time. Also the coating of Apostolos is relatively rigid and would be ineffective to bridge larger cracks often occurring in concrete.

The present invention provides a moisture impervious membrane or coating of improved conductivity which when given an electropositive charge reverses the anodic property of the reinforcing steel and thus all the reinforcing steel network becomes cathodic whereby no corrosion occurs.

Known waterproofing coating systems also suffer from the disadvantage that they are relatively inflexible and inelastic. Since hairline cracks in concrete can develop which are one-eighth of an inch or more in width, such coatings will fracture when stressed at the site of the crack. Shrinkage cracking of the coating may also occur.

The present invention provides a moisture impervious membrane or coating with inherent flexibility to bridge cracks without itself being fractured under normal extension under stress.

SUMMARY OF THE INVENTION

Essentially the invention consists of a protective coating for steel reinforced concrete structures, comprising a liquid composition of elastomeric polymeric material having electrically conductive particulate matter evenly dispersed therein and curable at ambient temperature to form a moisture impervious conductive membrane.

In another aspect the invention consists of a concrete structure containing steel reinforcing bars, a cathodic protection system comprising: a moisture impervious membrane of elastomeric polymeric material applied to the structure, the membrane having electrically conductive particulate matter evenly dispersed therein; an electrically conductive grid embedded in the membrane or contiguous thereto; and direct current means connecting the grid electrically with the reinforcing bars.

BRIEF DESCRIPTION OF THE DRAWINGS

An example embodiment of the invention is shown in the accompanying drawings in which.

DESCRIPTION OF PREFERRED EMBODIMENT

Figure 1:
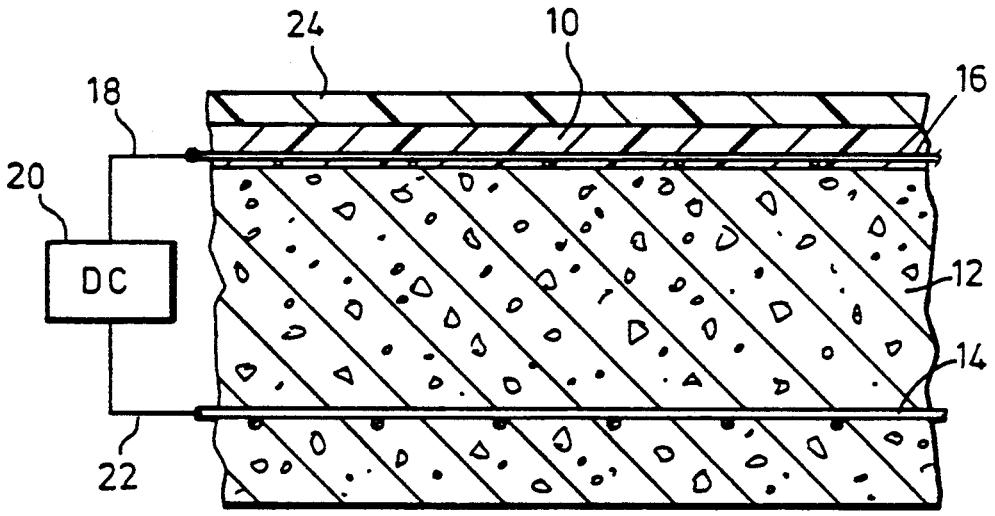
FIG. 1 is a cross-sectional view of a reinforced concrete slab having a protective coating system.

As seen in FIG. 1 of the drawings an impermeable membrane or coating 10 of the invention is applied to a concrete structure 12 containing reinforcing bars 14. Coating 10 has embedded in it, or contiguous to it, a primary anode of conductive wire material which is formed in a grid 16 connected electrically by a conductor 18 to a source 20 of direct current the source also being connected by a conductor 22 to reinforcing bars 14. A low electrical current flows between grid 16 and rebars 14 substantially equal and opposite to the current which would result from an electrical connection between the rebars and the grid, which inhibits electrolytic action on the rebars. A wear course 24 may be laid over coating 10.

The composition of coating 10 allows the current to be uniformly distributed throughout the coating. Examples of suitable formulations for forming the coatings of the invention are set forth below.

| I CHLOROPRENE MEMBRANES | |
|---|---|
| EXAMPLE I | |
| INGREDIENT | PERCENT BY WEIGHT |
| chloroprene latex solids | 28.8 |
| conductive carbon black | 8.7 |
| clay | 1.35 |
| thickening agent (polyacrylate) | 0.45 |
| water | 60.3 |
| anti-oxidant | 0.4 |
| PROPERTIES | |
| electrical resistivity | 20–100 ohm-cm |
| tensile strength | 870 psi |
| elongation at 72° F. | 500% |
| elongation at 0° F. | 150% |
| EXAMPLE II | |
| INGREDIENT | PERCENT BY WEIGHT |
| chloroprene latex solids | 31.0 |
| nickel powder (particulate) | 33.5 |
| water | 33.39 |
| thickening agent | 0.6 |
| anti-oxidant | 0.51 |
| wetting agent | 0.2 |
| PROPERTIES | |
| resistivity | 1–15 ohm-cm |
| tensile strength | 800 psi |

-continued

| | |
|---|---|
| elongation at 72° F. | 500% |
| elongation at 0° F. | 300% |

EXAMPLE III

| INGREDIENT | PERCENT BY WEIGHT |
|---|---|
| chloroprene latex solids | 38.03 |
| conductive carbon black | 3.7 |
| conductive carbon fibers | 8.1 |
| water | 49.55 |
| anti-oxidant | 0.42 |
| wetting agent | 0.2 |
| PROPERTIES | |
| resistivity | 10–20 ohm-cm |
| tensile strength | 600 psi |
| elongation at 72° F. | 450% |

EXAMPLE IV

| INGREDIENT | PERCENT BY WEIGHT |
|---|---|
| chloroprene latex solids | 39.0 |
| nickel coated graphite fibers | 0.36 |
| water | 45.74 |
| clay | 14.9 |
| PROPERTIES | |
| resistivity | 20–80 ohm-cm |
| tensile strength | 840 psi |
| elongation at 72° F. | 550% |

EXAMPLE V

| INGREDIENT | PERCENT BY WEIGHT |
|---|---|
| chloroprene latex solids | 30 |
| clay | 8.7 |
| conductive carbon black | 5.45 |
| nickel coated graphite | 0.3 |
| water | 55 |
| wetting agent | 0.05 |
| PROPERTIES | |
| resistivity | 40–50 ohm-cm |
| tensile strength | 800 psi |
| elongation at 72° F. | 450% |

EXAMPLE VI

| INGREDIENT | PERCENT BY WEIGHT |
|---|---|
| chloroprene latex solids | 25.44 |
| clay | 0.17 |
| nickel powder | 4.23 |
| other inorganic filler | 1.36 |
| conductive carbon black | 10.6 |
| water | 58.0 |
| wetting agent | 0.2 |
| PROPERTIES | |
| resistivity | 16–30 ohm-cm |
| tensile strength | 500 psi |
| elongation at 72° F. | 400% |

II URETHANE MEMBRANES

EXAMPLE I

| INGREDIENT | PERCENT BY WEIGHT |
|---|---|
| blocked urethane prepolymer | 46.91 |
| conductive nickel powder | 24.27 |
| nickel coated graphite fibers | 0.21 |
| xylene | 21.86 |
| curing agent | 3.88 |
| anti-oxidant | 1.00 |
| other | 1.87 |
| PROPERTIES | |
| resistivity | 0.5 ohm-cm |
| tensile strength | 420 psi |
| elongation at 72° F. | 240% |

EXAMPLE II

| INGREDIENT | PERCENT BY WEIGHT |
|---|---|
| blocked urethane prepolymer | 58.91 |
| conductive nickel powder | 6.09 |
| nickel coated graphite fibers | 0.15 |
| conductive carbon fibers | 5.69 |
| conductivity enhancer | 0.10 |
| xylene | 19.95 |
| curing agent | 4.87 |
| anti-oxidant | 1.00 |
| other | 2.36 |
| PROPERTIES | |
| resistivity | 0.5–4 ohm-cm |
| tensile strength | 505 psi |

-continued

| | |
|---|---|
| elongation at 72° F. | 835% |

EXAMPLE III

| INGREDIENT | PERCENT BY WEIGHT |
|---|---|
| blocked urethane prepolymer | 60.21 |
| conductive nickel powder | 7.79 |
| nickel coated graphite fibers | 0.11 |
| conductive carbon fibers | 3.11 |
| xylene | 20.39 |
| curing agent | 4.98 |
| anti-oxidant | 1.00 |
| other | 2.41 |
| PROPERTIES | |
| resistivity | 2–10 ohm-cm |
| tensile strength | 355 psi |
| elongation at 72° F. | 1000+% |

EXAMPLE IV

| INGREDIENT | PERCENT BY WEIGHT |
|---|---|
| blocked urethane prepolymer | 56.78 |
| conductive carbon black | 7.84 |
| nickel coated graphite fibers | 0.44 |
| wetting agent | 0.29 |
| xylene | 26.67 |
| curing agent | 4.7 |
| anti-oxidant | 1.00 |
| other | 2.28 |
| PROPERTIES | |
| resistivity | 2–5 ohm-cm |
| tensile strength | 245 psi |
| elongation at 72° F. | 195% |

A suitable chloroprene polymer is sold by Dupont de Nemours Inc. under the trade mark NEOPRENE. A suitable blocked urethane prepolymer is sold by Bayer AG under the trade mark DESMOCAP.

The composition for the coatings of the invention are liquid when formulated and are curable (that is, drying) at ambient temperatures (that is, at temperatures in the range about 40°–120° F.) in order to form a moisture impervious conductive membrane.

The thickness of membrane 10 depends upon the size of cracks in concrete 12 to be bridged. Generally membrane thickness of 0.020 inch to 0.030 inch would be required. In case of excessive roughness a parge coating on the concrete may be required to prepare the surface to receive membrane 10. The wire of grid 16 may be encapsulated in (i.e. embedded within) membrane 10 or the membrane may be laid as a secondary anode on top of the grid which would then be contiguous with the membrane. A suitable material for grid 16 is platinum (over niobium copper wire) which may be laid in strands about twenty feet apart, the spacing and gauge of the wire being dependent on the specific requirements of the system. The composition of coating 10 allows the current to be distributed evenly throughout the coating and reduces its resistivity which may be as low as 10 ohm-cm.

By providing uniform distribution of electric current localized disintegration, and the consequent destruction of the adjacent concrete, is avoided where chloride ions already exist in the concrete from salt penetration before the membrane is applied. Consequently the membrane performs the dual function of keeping water and salt from penetrating the concrete and inhibits the corrosive effects of chloride ions already present in the concrete.

A separate wear course such as a coal tar epoxy (sand) may be applied over membrane 10 in known manner.

If desired, membrane 10 may be prefabricated in sheets or sections and applied to the concrete substrate using an auxiliary binding agent such as a conductive primer adhesive.

The invention provides a moisture impervious membrane which is resistant to chloride ion penetration and neutralizes chloride ions already present in the concrete, has a high flexibility and elongation characteristics, and has low electrical resistivity. Additionally, the membrane has the ability to bond to concrete substrates and to have wear courses bond to it.

The term "impervious" means highly resistant to moisture transmission.

We claim:

1. In a concrete structure containing steel reinforcing bars, a cathodic protection system comprising:

(a) a moisture impervious membrane of polymeric elastomeric material selected from the group consisting of chloroprene rubber, blocked urethane, and chloroprene including a wetting agent, and an anti-oxidant, applied to the structure, the membrane having electrically conductive particulate matter selected from the group consisting of metallic powder, nickel coated graphite fibers, carbon fibers and conductive carbon black evenly dispersed therein;

(b) an electrically conductive grid embedded in the membrane or contiguous thereto; and (c) direct current means connecting the grid electrically with the reinforcing bars.

2. A system as claimed in claim 1 including a filler and a thickening agent.

3. A system as claimed in claim 1 in which the polymer is about 28.8% by weight chloroprene latex solids and the particulate matter is about 8.7% by weight conductive carbon black, and including about 1.35% by weight clay, about 0.45% by weight thickening agent, about 60.3% by weight water, and about 0.4% by weight anti-oxidant.

4. A system as claimed in claim 1 in which the polymer is about 31.0% by weight chloroprene latex solids and the particulate matter is about 33.5% by weight nickel powder and including about 33.39% by weight water, about 0.6% by weight thickening agent, about 0.51% by weight anti-oxidant, and about 0.2% by weight wetting agent.

5. A system as claimed in claim 1 in which the polymer is about 38.03% by weight chloroprene latex solids and the particulate matter is about 3.7% by weight conductive carbon black and about 8.1% by weight conductive carbon fibers, and including about 49.55% by weight water, about 0.42% by weight anti-oxidant, and about 0.2% by weight wetting agent.

6. A system as claimed in claim 1 in which the polymer is about 39.0% by weight chloroprene latex solids, and the particulate matter is about 0.36% by weight nickel coated graphite fibers and including about 45.74% by weight water and about 14.9% by weight clay.

7. A system as claimed in claim 1 in which the polymer is about 30.0% by weight chloroprene latex solids, and the particulate matter is about 5.45% by weight conductive carbon black and about 0.3% by weight nickel coated graphite fibers and including about 55% by weight water about 8.7% by weight clay and about 0.05% by weight wetting agent.

8. A system as claimed in claim 1 in which the polymer is about 25.44% by weight chloroprene latex solids, and the particulate matter is about 4.23% by weight nickel powder and about 10.6% by weight conductive carbon black and including about 0.17% by weight clay, about 1.36% by weight other inorganic filler, about 58% by weight water and about 0.2% by weight wetting agent.

9. A system as claimed in claim 1 in which the polymer is about 46.91% by weight of a blocked urethane prepolymer and the particulate matter is about 24.27% by weight nickel powder and about 0.21% by weight nickel coated graphite fibers and including about 21.86% by weight xylene, about 3.88% by weight curing agent and about 1.0% by weight anti-oxidant.

10. A system as claimed in claim 1 in which the polymer is about 58.91% by weight of a blocked urethane prepolymer and the particulate matter is about 6.09% by weight of nickel powder, about 0.15% by weight nickel coated graphite fibers, and about 5.69% by weight carbon fibers and including 0.1% by weight of a conductivity enhancer, about 19.95% by weight xylene, about 4.87% by weight curing agent, and about 1.0% by weight of an anti-oxidant.

11. A system as claimed in claim 1 in which the polymer is about 60.21% by weight of a blocked urethane prepolymer and the particulate matter is about 7.79% by weight nickel powder, about 0.11% by weight nickel coated graphite fibers, and about 3.11% by weight carbon fibers and including about 20.39% by weight xylene, about 4.98% by weight curing agent, and about 1.0% by weight of an anti-oxidant.

12. A system as claimed in claim 1 in which the polymer is about 56.78% by weight of a blocked urethane prepolymer and the particulate matter is about 7.84% by weight conductive carbon black, 0.44% by weight nickel coated graphite fibers, and including about 0.29% by weight wetting agent, about 26.67% by weight xylene, about 4.7% curing agent and about 1.0% by weight of anti-oxidant.

* * * * *